United States Patent [19]

Witting

[11] 3,936,066

[45] Feb. 3, 1976

[54] SAFETY SKI BINDING

[76] Inventor: Gerhard Witting, Clemensstrasse 121, D8 Munich 40, Germany

[22] Filed: Sept. 26, 1974

[21] Appl. No.: 509,494

[30] Foreign Application Priority Data

Sept. 28, 1973 Germany ..... 2348905

[52] U.S. Cl. ..... 280/11.35 N

[51] Int. Cl.² ..... A63C 9/08

[58] Field of Search ...280/11.35 N, 11.35 K, 11.35 Y, 280/11.35 C, 11.35 A, 11.35 P, 11.35 E, 11.35 R

[56] References Cited

UNITED STATES PATENTS

| | | | |
|---|---|---|---|
| 3,822,070 | 7/1974 | Salomon | 280/11.35 N |
| 3,825,274 | 7/1974 | Weinstein | 280/11.35 N |
| 3,844,575 | 10/1974 | Salomon | 280/11.35 N |

FOREIGN PATENTS OR APPLICATIONS

| | | | |
|---|---|---|---|
| 1,916,654 | 10/1970 | Germany | 280/11.35 N |

*Primary Examiner*—Robert R. Song
*Assistant Examiner*—Milton L. Smith
*Attorney, Agent, or Firm*—Burns, Doane, Swecker & Mathis

[57] ABSTRACT

A safety ski binding with a rigid base plate arranged between the ski boot and the ski. The ski boot is detachably fastened by hand to the base plate. The base plate is permanently connected with the ski by means of two steel cables which are anchored inside of the base plate by springs so as to yield elastically in case of a fall of the skier.

6 Claims, 3 Drawing Figures

SAFETY SKI BINDING

The present invention relates to a safety ski binding which automatically interrupts the firm connection between the skier's leg and the ski when excessive holding forces are generated typically during a fall.

Safety ski bindings are known which comprise a base plate between the ski and the ski boot. These are the so-called plate bindings. The ski boot is fastened in such manner to the base plate that it can only be released intentionally by the skier. To connect the base plate with the ski, for instance, two locking means or catch devices are provided sunk in the base plate. They each comprise a catch element such as a ball or roll cooperating with a socket member at a holder means on the ski associated with the respective catch device. When the holding force effective between the ski and the ski boot surpasses a certain threshold value which can be fixed either by adjustment or by design of the catch device, the catch element will be released from the socket member so that the ski boot together with the base plate will be completely freed from the ski.

The safety ski binding described permits very good accuracy in keeping the threshold values of the holding force under the various operating conditions, which values are decisive for the different typical types of falls (head-on fall, twist fall) and should be set in each individual case in accordance with the load that might cause bone fracture of the respective skier. Yet this is possible only at the price of a very complicated structural design and only with very accurate manufacture of the two catch devices and also of the associated holder means. In addition, a suspension means or catching string is needed to keep a loose connection between the ski boot and the ski released upon actuation of the binding so that the ski will not be lost. Furthermore, the catch devices require special measures so that the skier can reset the safety ski binding lock again as easily as possible after an automatic release.

Finally, there is the problem of variation of the spacing between the front and rear holder means on the ski in dependence on the respective deflection of the same under load. Due to this circumstance the release characteristics of the binding depend to a certain extent on the instantaneous dynamic loads on the ski during skiing. Here, too, remedial measures are feasible by a suitable, yet more expensive design of the safety ski binding, especially by locating the automatic release between the base plate and the ski boot and instead designing the base plate such that it is to be fastened releasably by hand at the ski. This, however, requires a specifically adapted ski boot so that the usual ski boots cannot be used.

It is an object of the present invention to provide a safety ski binding of simple design, which, although being inexpensive to manufacture, provides a sufficient degree of safety to the average skier.

it is also an object of the invention to provide a safety ski binding which is easy to handle.

It is another object of the invention to provide a safety ski binding which can be used with ordinary ski boots.

These and other objects which will become apparent from the description below are met by the invention in that it provides a safety ski binding, comprising a rigid base plate arranged between the sole of the ski boot and the ski for detachable fastening by hand of the ski boot, said base plate including two release devices which establish an automatically releasable connection between the base plate and the ski, the automatic release being effected upon occurrence of an excessive holding force, each of said release devices being provided with a cable means anchored at the base plate by at least one spring means so as to yield elastically and fixed to the ski by a free section passed out of said base plate.

The novel safety ski binding is based on the conception of completely dispensing with catch means and the respective total liberation of the ski as certain holding forces are surpassed and instead providing an elastically yielding connection between the ski boot, or rather the base plate fastened to the ski boot, and the ski, a connection which will always remain intact, even upon falls. It was discovered that a safety ski binding operating according to this principle, on the one hand, affords sufficient protection for the average skier against the risk of bone fracture and, on the other hand, satisfies the demands by average skiers as to the running behavior of a binding, in particular the rigidity of the connection between the ski boot and the ski.

With the safety ski binding according to the invention the permanent elastically yielding connection between the base plate and the ski is effected in the simplest manner by two cables anchored for elastic yielding in the base plate. This provides a very simple structure not requiring any particular manufacturing precision and thus being inexpensive. The bias imparted to the cables by a spring or springs associated with each of them in unreleased condition of the binding determines the threshold value of the holding force, upon the surpassing of which the base plate begins to come loose from the ski because part of the cable of at least one of the two release devices is pulled out against the force of the supporting spring or springs. This length of cable is sufficient to reduce the dangerous leverage of the ski on the skier's leg to such an extent that bone fracture is avoided. The action of the safety ski binding is adapted in a known manner to the different types of falls by respective selection of the spring rate for the front and rear release devices. It is a particular advantage of the safety ski binding according to the invention that no special measures are needed to reestablish the connection between the ski boot and the ski after a fall. Rather, when the holding force diminishes, the ski is automatically pulled back by the cables into the proper position at the base plate which is fixed to the ski boot. This requires no particular cooperation by the skier. Even false releases caused by brief dynamic overloads can no longer occur. Instead, such overloads are automatically accomodated elastically. It is another advantage of the safety ski binding according to the invention that its release characteristics are practically independent of the respective operating conditions, especially temperature and the influences of snow and water. Also, deflections of the ski during skiing have no noticeable influence on the release behavior. Any ordinary ski boot may be used with the novel safety ski binding. The fastening by hand to the base plate of the safety ski binding is done in the usual manner, for instance, by means of a hook engaging over the front edge of the sole of the ski boot and a closure strap for engagement with the heel.

A greater length of cable can be drawn out of the release devices and thus a greater degree of freedom obtained between the ski and base plate or ski boot in case of a fall by use of a tackle-type arrangement utilizing a movable guide roller for the cable. If the cable of only one release device is guided in such manner, it is preferable to choose the front one. It is there that, with a twist fall, a greater length of cable is needed more than with the rear release device which mainly becomes effective with head-on falls.

The preferred embodiment of the novel safety ski binding comprises a base plate in the form of two dish-shaped halves or shell halves. The two halves are moldable from plastic material in a very uncomplicated process step and may simply be joined by screws after having been provided with the respective springs and rollers to present the two release devices. The shell construction or semi-monocoque construction still provides a stable base plate. The fixing of the cables at the ski is best effected by two holder means disposed on the ski in front of and behind the base plate and preferably also made from plastics. By these overall measures a very inexpensive and light-weight safety ski binding is obtained.

In order that the invention may be clearly understood and readily carried into effect an embodiment thereof will now be described by way of example with reference to the accompanying drawing, in which.

Figure 1:
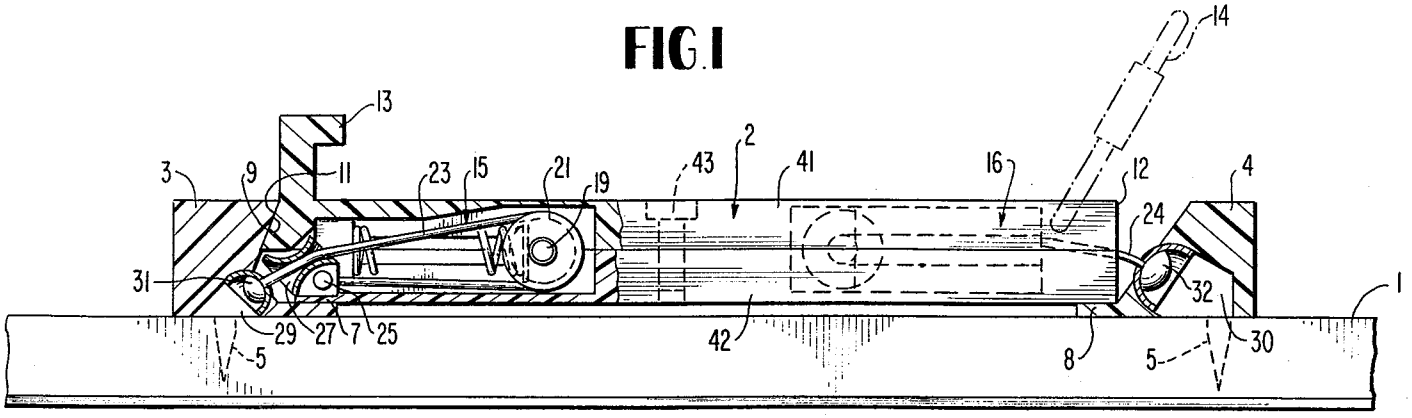
FIG. 1 is a partly sectional side elevation of a safety ski binding according to the invention.
Figure 2:
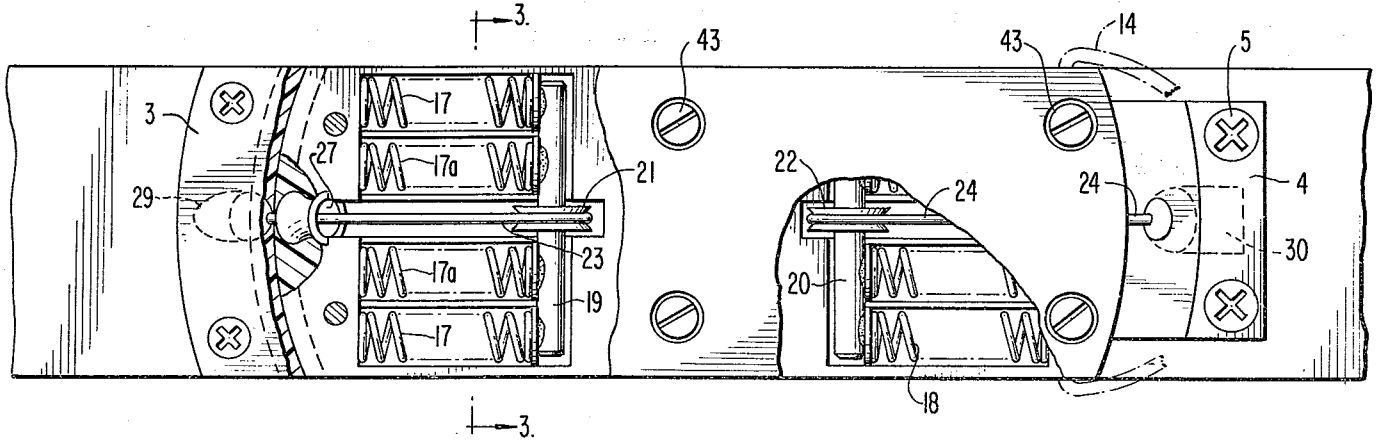
FIG. 2 is a partly sectional plan view of the safety ski binding shown in FIG. 1.

With reference to the drawings, the safety ski binding according to the invention is shown in normal condition, i.e. unreleased and mounted on a ski 1. The safety ski binding comprises a rigid base plate 2 and a front and rear retaining means or holder 3 and 4, respectively. The two holders, preferably made from polyamide, are secured to the ski 1 by screws 5 at such spacing that there is just enough room between them for the length of the base plate 2. The two holders 3 and 4 each include an integral support face 7 and 8 on which the base plate 2 rests in normal condition, leaving a slight clearance between it and the surface of the ski 1. In the direction of the width of the ski the front holder 3 is curved about a center of curvature located in the area of the heel of the base plate 2 or rather of the boot placed on the base plate, and it has a guide face 9 formed in accordance with this curvature, facing the base plate 2, and rising at an inclination rearwardly away from the ski 1. The base plate 2 has a front face 11 formed complementary to the guide face 9 and abutting the same under normal conditions so as to prevent any lifting of the base plate 2 from the holder 3.

A ski boot (not shown) can be fastened releasably by hand on the base plate 2. To this end the base plate 2 is provided at its front end with a conventional hook 13 which extends across the full width of the base plate and is adapted to the curvature of the front face 11 of the base plate 2. The hook 13 is adapted to engage over the front edge of the sole of the ski boot. The base plate 2 is provided at its rear end with a closure strap 14 shown only diagrammatically and operable in the usual manner by hand. When closed, the strap 14 holds the ski boot against the base plate 2 in the area of the heel and presses it under the hook 13 at the front end.

Two release devices 15 and 16 are inserted or sunk in the base plate 2 to establish an automatically releasable connection between the base plate with the ski boot fastened to it on the one hand and the ski 1 with the holders 3 and 4 secured to it on the other hand, the automatic release being effected upon application of an excessive holding force. As both release devices have the same structure, only the front release device 15 will be described in detail.

The release device 15 comprises four helical compression springs 17 in parallel side-by-side arrangement in the longitudinal direction of the base plate. The compression springs 17 are disposed in pairs symmetrically at either side of the longitudinal axis, leaving a greater transverse spacing between the two inner springs 17*a*. The compression springs are firmly supported at their front ends, as seen in the skiing direction. A bearing pin 19 extending transversely on the base plate 2 abuts against the rear ends of the compression springs. A guide roller 21 is supported for rotation on the bearing pin in the middle between the inner compression springs 17*a*. The bearing pin is movable in a direction transversely of its longitudinal extension, i.e. in longitudinal direction of the base plate 2 against the force of the compression springs 17.

A steel cable 23 is firmly anchored by means of a retaining pin 25 in the middle of the base plate 2 just behind the front face 11 thereof and in the lower zone adjacent the ski 1. The steel cable 23 is passed between the two inner compression springs 17*a*, from below around the guide roller 21, and back to an opening 27 in the front face 11 of the base plate 2. The opening 27 is located in the middle of the front face 11 above the retaining pin 25 and extends at an inclination downwardly from the inside to the outside, in other words downwards in the running direction of the ski 1, flaring outwardly with rounded edges. The steel cable 23 issuing from the base plate 2 is passed out of the opening 27 and anchored by its free end section in the middle of the front holder 3 in an opening 29 disposed directly opposite the opening 27 when the safety ski binding is in its normal condition. The opening 29 is formed in the holder 3 from the bottom surface thereof which is covered by the ski 1. It converges rearwardly towards the base plate 2, the steel cable 23 being fixed in the opening 29 by a suitable thickened end portion 31. The compression springs 17 bias the steel cable 23 such that, under normal conditions, it effects the close abutment of the front face 11 of the base plate 2 against the guide face 9 of the holder 3.

For the rear release device 16, having the same structure as the front release device, corresponding elements are provided with corresponding even reference numerals, each increased by one. The rear release device 16 is mounted in the base plate 2 rotated through 180° as compared to the front release device so that the steel cable 24 thereof is passed out of the base plate 2 at the rear face 12 thereof towards the rear holder 4. The compression springs 18 of the rear release device are much stronger than those of the front release device in correspondence with the considerably greater holding forces required in the heel zone as compared to the holding forces needed in the area of the toes.

The base plate 2 is composed of two flat dish-shaped halves or shell halves 41 and 42 made from plastic material, such as polyamide, placed against each other in the middle of the base plate in a contact plane extending parallel to the ski 1, and joined together by screws 43. In the respective contact plane both halves are formed with corresponding recesses to house the respective individual elements of the two release devices 15 and 16. During assembly this permits the individual elements to be simply placed, for instance, in the recesses of the lower half 42. They will be held against accidental removal upon fastening of the upper half 41 by the screws.

Figure 3:
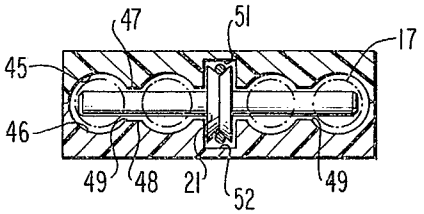
FIG. 3 is a sectional view taken along lines 3—3 of FIG. 2.

In particular, each half 41 and 42 is formed with a recess of semicircular cross-sectional shape for each of the compression springs 17 and 18, as may be seen from FIG. 3 which relates to the front release device 15 but is applicable to the rear release device as well. Between the recesses 45 and 46, respectively, there are webs or lands 47 and 48, respectively, each ending slightly below the mutual contact plane of the two halves 41 and 42, so that upon joining of the halves, slots 49 will be formed between opposed lands extending parallel to the recesses 45 and 46. The height of the slots 49 is designed to correspond to the diameter of the bearing pin 19 and 20, respectively, for the guide roller 21 and 22, respectively, so that the bearing pin is guided for movement in the slots 49, as described above. In the middle between the semicircular recesses 45 and 46 each half is formed with a recess 51 and 52, respectively, of rectangular cross-sectional shape permitting movement of the guide roller 21 and 22, respectively.

In operation the ski boot of a skier is fastened to the base plate 2 by means of the hook 13 and the strap 14, and the base plate 2 in turn is secured to the holders 3 and 4 and thus to the ski 1 by means of the biased steel cables 23 and 24 thus adopting the normal condition shown during normal skiing. However, if excessive holding forces are generated, especially during a fall, at least one of the steel cables will be drawn out of the base plate 2 against the force of the compression springs 17 or 18 so that the ski with its holders will be freed from the base plate 2 and thus from the ski boot and therefore can no longer harm the skier's leg by its leverage. In case of a so-called head-on fall, it is primarily the rear release device 16 which comes into action, whereas with a so-called twist fall mainly the front release device is actuated. When the excessive holding forces have ceased to exist, the ski is automatically pulled into the proper position toward the base plate 2 by the forces exerted by the compression springs 17 and 18 on the steel cables 23, and 24, respectively. If the safety ski binding is to be opened voluntarily, for instance, to take off the ski, the strap 14 is actuated once more by hand.

The invention may be embodied in other forms without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A safety ski binding comprising a rigid base plate arranged for detachable fastening to a ski boot, said base plate including two spaced release devices for establishing automatically releasable connections between the base plate and the ski, the automatic release being effected upon occurrence of an excessive force tending to separate said base plate and ski at the location of a release device, said release devices each including at least one guide roller mounted for movement along said base plate transversely of the roller axis, cable means fixed at one end to said base plate and passing over said guide roller and outwardly of said base plate for attachment to the ski, and spring means biasing said guide roller along its path of movement for applying tension to said cable means and permitting it to be drawn a distance from said base plate greater than said guide roller moves in response thereto.

2. A safety ski binding as claimed in claim 1, wherein said guide roller is supported on a bearing member which is displaceable longitudinally of said base plate and which engages the ends of compression springs compressible longitudinally of said base plate.

3. A safety ski binding as claimed in claim 2, wherein said base plate comprises two superimposed shell halves providing inner recesses in which the guide roller, compression springs, and the larger portion of the cable means are disposed.

4. The safety ski binding as claimed in claim 3 wherein each shell half includes similar recesses, said recesses including longitudinal portions shaped to house each said compression spring with a slot left between said portions to provide a longitudinal guide for the bearing member for said guide roller.

5. A safety ski binding as claimed in claim 1, wherein said cable means pass out of said base plate through openings flaring outwardly with rounded edges and provided in the front and rear end faces of the base plate at a downward inclination of the ski from inside to outside.

6. A safety ski binding as claimed in claim 1, wherein the portions of said cable means passing outwardly of said base plate are attached to holder means secured to the ski at the front and rear end, respectively, of said base plate.

* * * * *